US010577825B1

(12) United States Patent
Givens et al.

(10) Patent No.: US 10,577,825 B1
(45) Date of Patent: Mar. 3, 2020

(54) CONDUCTIVE BARRIER

(71) Applicant: Ameristar Perimeter Security USA Inc., Tulsa, OK (US)

(72) Inventors: Fred L. Givens, Tulsa, OK (US); Michael D. Elmore, Tulsa, OK (US); Bryan L. Hudson, Tulsa, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 456 days.

(21) Appl. No.: 15/218,680

(22) Filed: Jul. 25, 2016

Related U.S. Application Data

(60) Provisional application No. 62/198,704, filed on Jul. 30, 2015.

(51) Int. Cl.
*E04H 17/14* (2006.01)
*E04H 17/16* (2006.01)

(52) U.S. Cl.
CPC ..... *E04H 17/1434* (2013.01); *E04H 17/166* (2013.01); *E04H 2017/1447* (2013.01)

(58) Field of Classification Search
CPC ..... E04H 17/166; E04H 17/1434; E04H 2017/1447
USPC ..... 256/21, 22, 59, 67, 72, 65.02, 65.03, 256/DIG. 5; 411/338, 399
See application file for complete search history.

(56) References Cited

U.S. PATENT DOCUMENTS 1,498,127 A * 6/1924 Sommer ..... E04H 17/1443 256/21
2,346,111 A * 4/1944 MacKenzie ..... 160/161
2,520,313 A * 8/1950 Harris ..... E04H 17/1434 256/22
3,682,508 A * 8/1972 Briles ..... F16B 4/004 403/408.1
3,902,703 A * 9/1975 Bouye ..... E04H 17/1426 256/19
4,983,085 A * 1/1991 Gray ..... B25B 13/48 411/336
5,402,987 A * 4/1995 Duyck ..... E01F 15/0453 256/13.1
6,190,102 B1 * 2/2001 Vignotto ..... B60B 3/165 301/105.1
6,672,569 B2 * 1/2004 Deeley ..... E04H 17/003 256/22
6,874,767 B1 * 4/2005 Gibbs ..... E04H 17/1434 256/65.02
7,134,646 B1 * 11/2006 Brooks ..... E04H 17/143 256/65.02
7,159,853 B2 * 1/2007 Gibbs ..... B21F 27/10 256/21

(Continued)

*Primary Examiner* — Daniel J Wiley
(74) *Attorney, Agent, or Firm* — Gary Peterson

(57) ABSTRACT

Structural components of a barrier, including posts, rails and pickets, are formed from a conductive substrate that is encased in a corrosion-resistant nonconductive coating. These structural components are assembled by aligning fastener openings in a pair of components, and joining the paired components with a conductive bolt. The shank of the bolt has an enlarged section of peripheral longitudinal ridges that forms an interference fit within each of the aligned fastener openings. Forming this interference fit abrades away the nonconductive coating within the openings, and allows the shank to form a conductive link between the joined structural components.

22 Claims, 12 Drawing Sheets

(56) References Cited

U.S. PATENT DOCUMENTS

| | | | | |
|---|---|---|---|---|
| 7,192,234 | B2 * | 3/2007 | Anderson | F16B 5/02 411/338 |
| 7,421,769 | B2 | 9/2008 | Lawrence et al. | |
| 7,475,868 | B1 * | 1/2009 | Gibbs | E01F 15/06 256/1 |
| 7,651,073 | B1 * | 1/2010 | Gibbs | E04H 17/1434 256/59 |
| 7,942,384 | B1 * | 5/2011 | Gibbs | E04H 17/143 256/1 |
| 8,070,404 | B1 * | 12/2011 | Schluter | F16B 39/282 411/368 |
| 8,382,070 | B1 | 2/2013 | Gibbs | |
| 8,720,866 | B1 * | 5/2014 | Gibbs | E04H 17/1434 256/65.02 |
| 2003/0164484 | A1 * | 9/2003 | Deeley | E04H 17/003 256/22 |
| 2005/0116212 | A1 * | 6/2005 | Deeley | E04H 17/003 256/22 |
| 2007/0166125 | A1 * | 7/2007 | Sukup | F16B 5/02 411/399 |
| 2007/0221902 | A1 * | 9/2007 | Kerr | E04H 17/143 256/22 |
| 2011/0278525 | A1 * | 11/2011 | Dale | E04H 17/1434 256/21 |
| 2013/0026433 | A1 * | 1/2013 | Duffy | E04H 17/1439 256/67 |

* cited by examiner

CONDUCTIVE BARRIER

SUMMARY OF THE INVENTION

A barrier is formed from a plurality of structural components. Each structural component is formed from a conductive substrate encased by a nonconductive coating, and is penetrated by at least one fastener opening. A plurality of fasteners joins pairs of structural components Each fastener includes a conductive bolt having an elongate shank. The shank includes an externally threaded first section formed at or adjacent one of its ends, and a longitudinally offset second section. The second section forms an interference fit within the aligned fastener openings of a pair of structural components.

A kit is formed from a plurality of structural components and a plurality of fasteners adapted to join pairs of structural components. Each structural component is formed from a conductive substrate encased by a nonconductive coating, and is penetrated by at least one fastener opening.

Each fastener includes a conductive bolt having an elongate shank. The shank includes an externally threaded first section formed at or adjacent one of its ends, and a longitudinally offset second section. The second section is adapted to form an interference fit within the aligned fastener openings of a pair of structural components.

BRIEF DESCRIPTION OF THE DRAWINGS

FIG. 6 is an end view of the rail shown in FIG. 4, taken along line 6-6.

FIG. 16 is a cross-sectional view showing a picket installed on a rail.

FIG. 19 is an enlarged cross-sectional view of the rail-post assembly of FIG. 18, showing the positioning of the bolt and nut.

DETAILED DESCRIPTION

A barrier 10, such as a fence, is formed from a plurality of structural components 12. Each structural component 12 is preferably formed from a conductive substrate encased by a nonconductive coating and is penetrated by at least one fastener opening.

Figure 1:
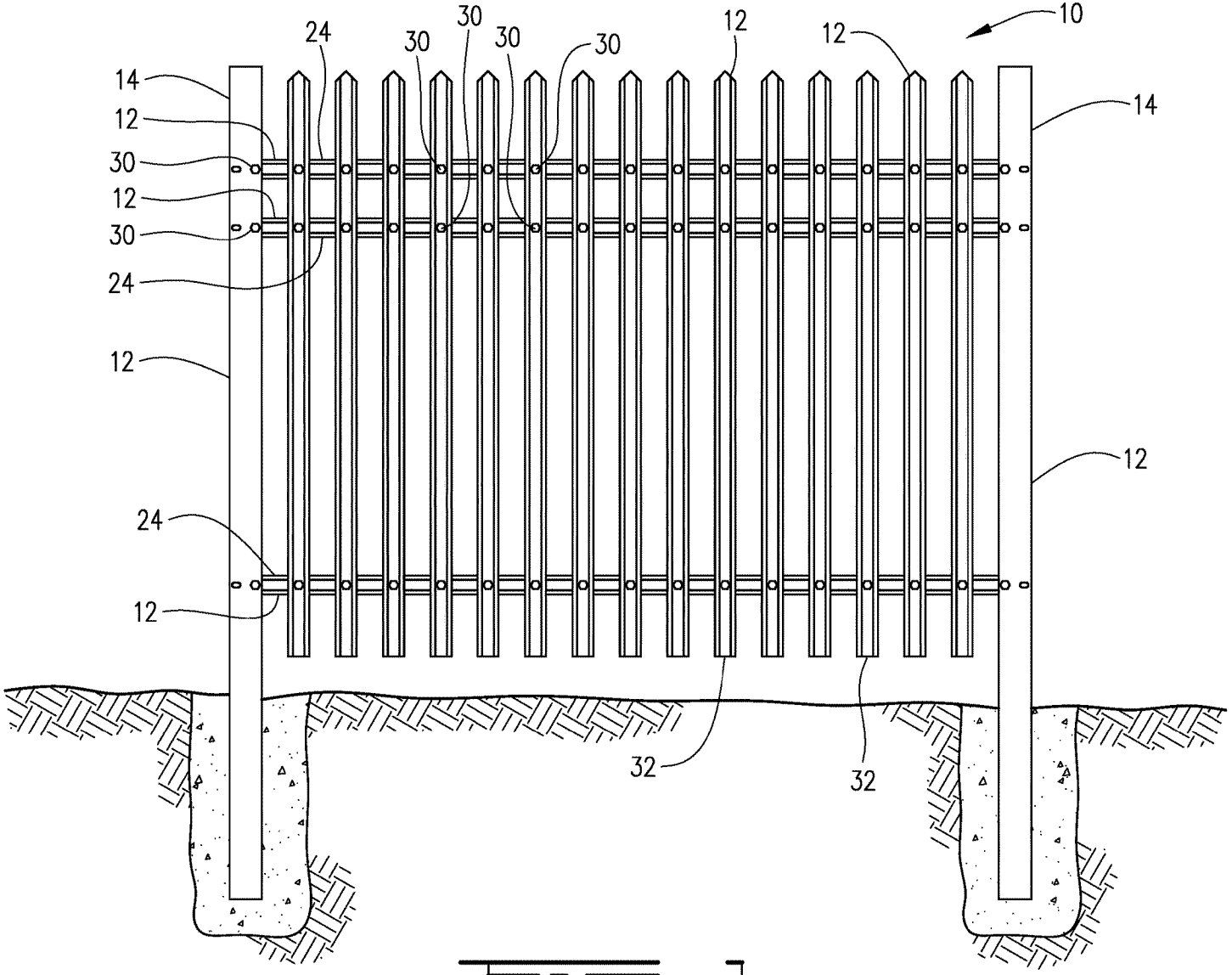
FIG. 1 is a front elevation view of a section of a barrier. The supporting terrain and substrates are shown in cross section.
Figure 2:
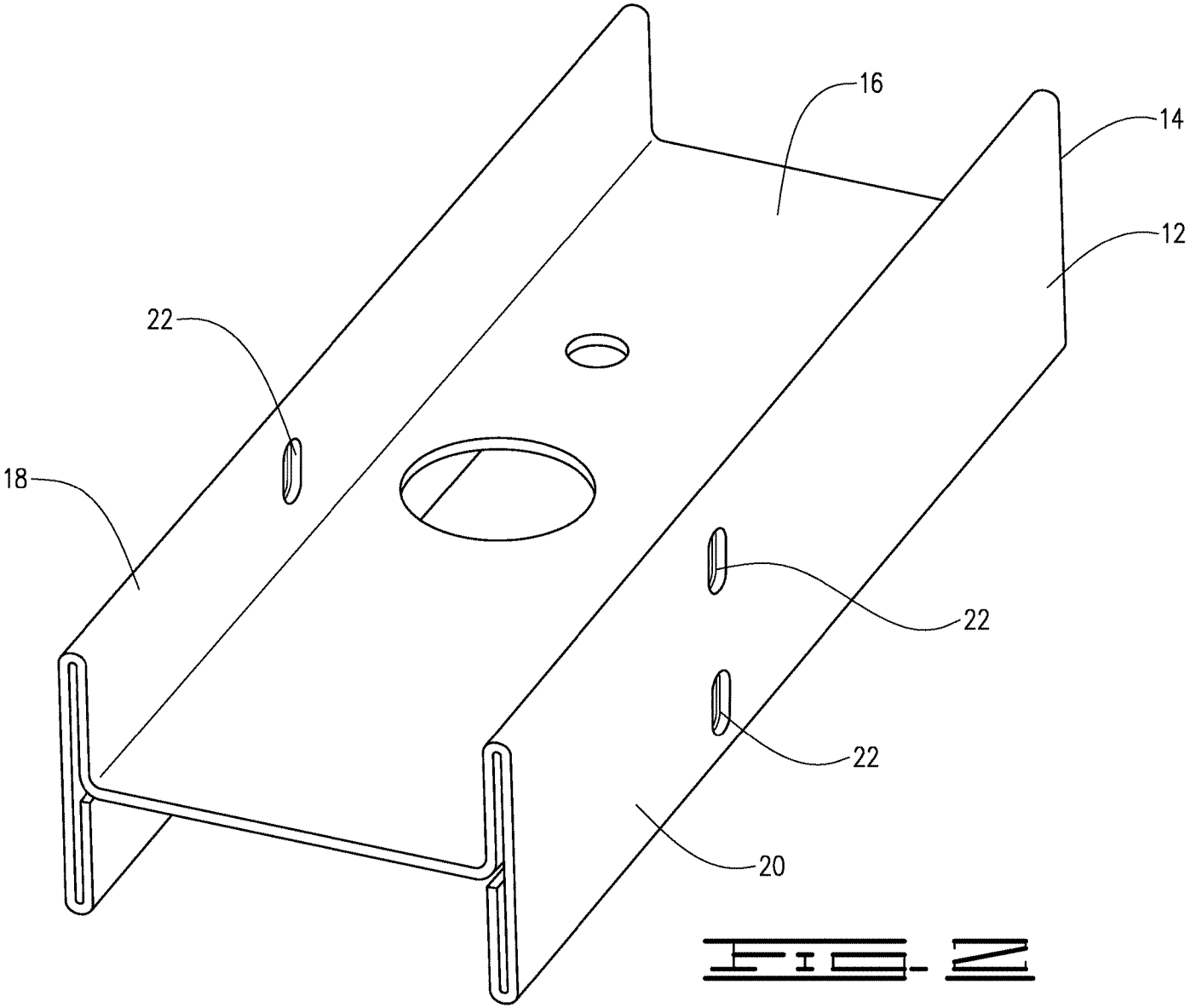
FIG. 2 is a perspective view of part of a post.
Figure 3:
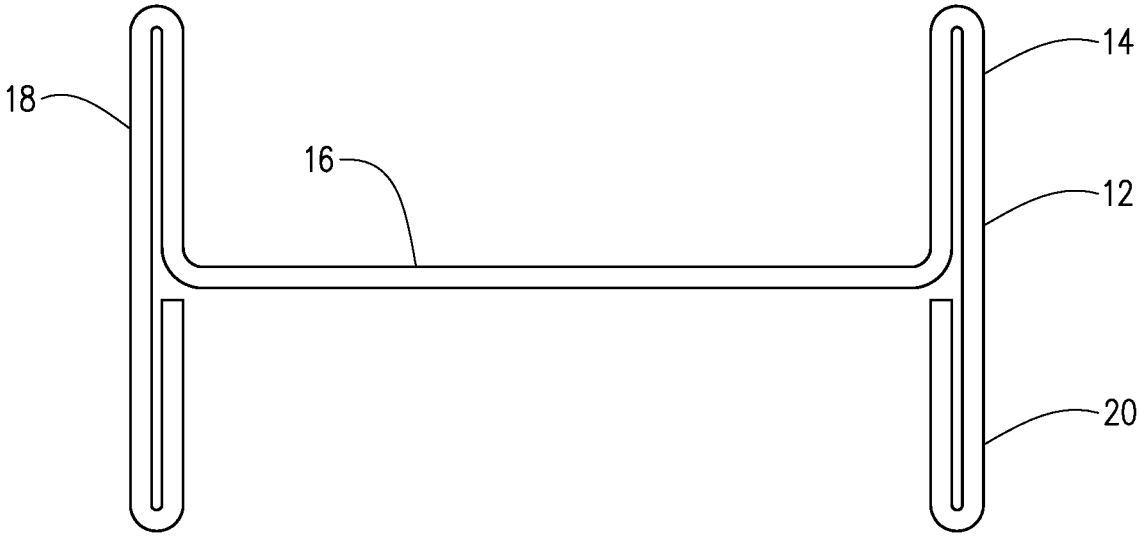
FIG. 3 is a top plan view of the post shown in FIG. 2.
Figure 5:
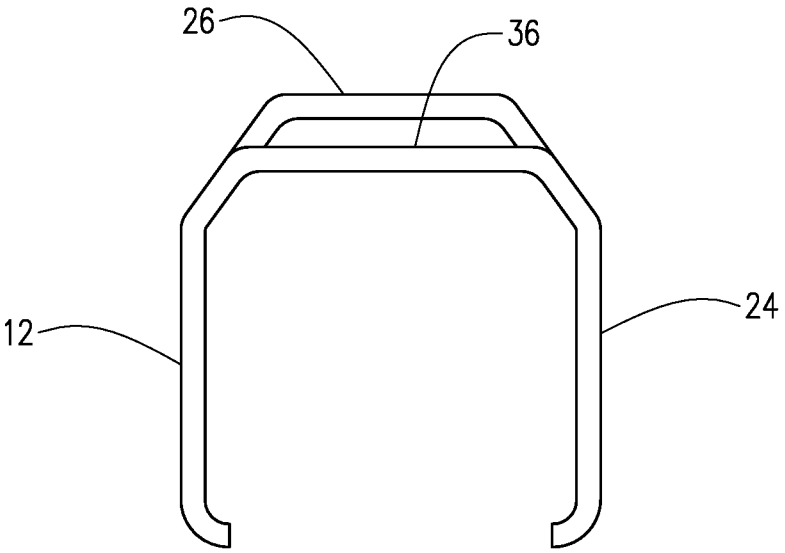
FIG. 5 is a top plan view of the rail shown in FIG. 4, taken along line 5-5.

The structural components 12 preferably comprise a plurality of elongate posts 14, shown in FIGS. 1-3. The posts 14 forming the barrier 10 are preferably identical in size, shape and construction.

Each post 14 is preferably formed from a strong, durable and conductive substrate such as a strip of sheet steel. To enhance its resistance to corrosion, this steel is preferably galvanized. In one embodiment, the steel is characterized by a thickness of 0.11 inches. The galvanized steel strip undergoes a cold rolling process to produce the cross-sectional shape shown in FIG. 3. After fabrication is complete, a nonconductive polyester powder coating is preferably applied, to encase the substrate and further enhance the post's resistance to corrosion.

Each post 14 is preferably characterized by the I-shaped cross section shown in FIG. 3. The post features a flat and elongate web 16 having a pair of laterally spaced edges. Spaced flanges 18 and 20 are formed adjacent each edge of the web 16. The flanges 18 and 20 cooperate with the web 16 to form at least one, and preferably two channel-shaped regions. As shown in FIG. 2, the two channel-shaped regions are separated by the web 16.

The web 16 and flanges 18 and 20 preferably comprise regions of the same single piece of material, preferably a strip of sheet steel. Each of the flanges 18 and 20 is separated from the adjacent web 16 by a fold in the material. In one embodiment, the web is 3.890 inches in width, while each of the flanges is 2.735 inches in width. In another embodiment, the web is 2.900 inches in width, while each of the flanges is 2.735 inches in width.

Each of the flanges 18 and 20 is characterized by a substantially flat double-walled structure, while the flat web 16 is a single-walled structure. The double walls of the flanges 18 and 20 are preferably formed by folding planar portions of strip steel into an overlapping and abutting configuration. This overlapping configuration improves resistance to corrosion and enhances the strength of the post 14.

At least one, and preferably a plurality of identically-sized fastener openings 22 are formed in each of the flanges 18 and 20. The number of fastener openings 22 formed in a given flange should be at least as great as the number of rails to be attached to that flange.

Preferably each fastener opening 22 in a given flange is matched with a second opening 22 situated on the opposite side of the web 16. Each fastener opening 22 should be longitudinally positioned at a height that matches the height of one of the rails to be installed in the barrier 10. Preferably, each fastener opening 22 in each flange is matched by a fastener opening 22 of equal height in the opposite flange of the post 14.

The fastener openings 22 are preferably formed by punching holes in the sheet of material from which the post 14 is formed, before it is cold-rolled. Because each flange is double-walled, two holes must be made in the material for each opening to be formed. When the double-walled flange is formed by folding, the paired holes register and form a single fastener opening 22.

In one embodiment, each fastener opening 22 is formed in an oblate shape. The major axis of the opening 22 is disposed in perpendicular relationship to the longitudinal axis of the post 14. The width of the opening 22 is about 0.35 inches, which is also the minimum dimension of the opening 22. The maximum length of opening 22 is about 0.75 inches. The center-to-center separation distance between adjacent fastener openings 22 on the same flange is 1.485 inches.

The upper end of each post 14 may be formed into a pointed or sharpened shape that will deter and hinder climbing. A spear or spike shape is acceptable for this purpose. Alternately, posts having rounded or flat tops may be used. The post 14 shown in FIG. 1 features a flat upper end.

Further details about the construction of the posts 14 are provided in U.S. Pat. No. 8,382,070, the entire disclosure of which is incorporated by reference.

The structural components 12 preferably further comprise a plurality of elongate rails 24, shown in detail in FIGS. 4-8. The rails 24 forming the barrier 10 are preferably of identical size, shape and construction. Each rail 24 is preferably formed from a strong, durable and conductive substrate such as a strip of sheet steel. In one embodiment, the steel is characterized by a thickness of 0.11 inches. To enhance its resistance to corrosion, this steel is preferably galvanized. After fabrication is complete, a nonconductive polyester powder coating is preferably applied, to encase the substrate and further enhance the rail's resistance to corrosion.

Each rail 24 is a channel-shaped member having a first end and an opposed second end. The rail 24 includes a first end portion situated adjacent the first end, and a second end portion situated adjacent the second end. An elongate intermediate portion extends between the first and second end portions.

Figure 4:
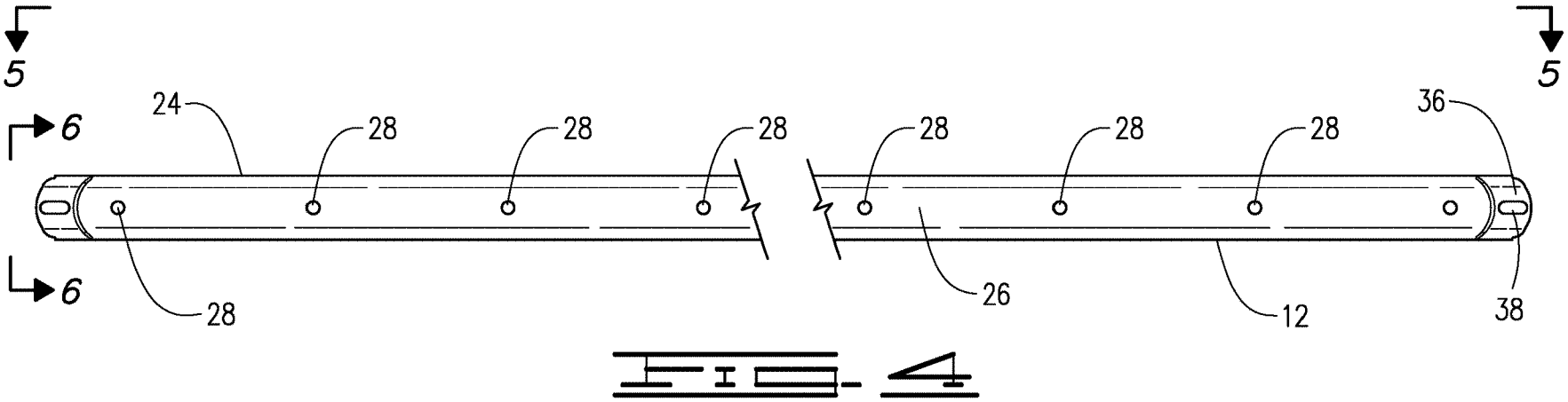
FIG. 4 is a front elevation view of a rail. A medial portion of the rail has been cut away.
Figure 5:
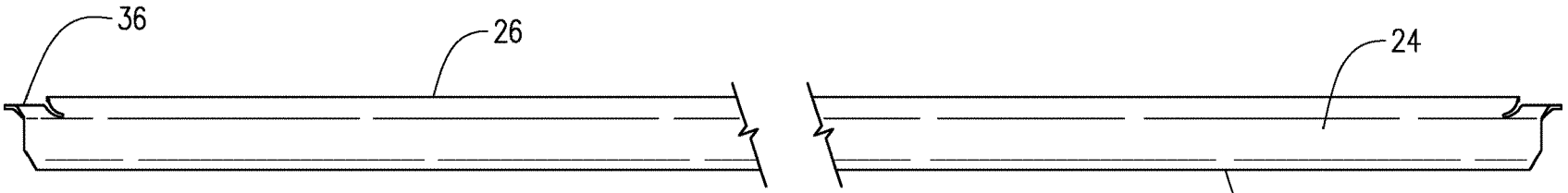

The intermediate portion comprises a lower section and an upper section. These sections are joined by a planar, vertically extending flat section 26. Preferably, the lower and upper sections are symmetrical about a bisecting plane that extends orthogonally through the flat section 26. As shown in FIG. 4, a plurality of longitudinally spaced fastener openings 28 are formed in the flat section 26. Preferably, the fastener openings 28 are identically shaped and circular. In one embodiment, the diameter of each fastener opening is about 0.35 inches, which is also the minimum dimension of the opening 28.

As shown in FIG. 6, the lower section includes a slanted lower front wall, which joins the flat section 26 to a horizontally extending base wall. The base wall in turn joins the lower front wall to a vertically upturned first lip. The lower front wall and base wall are each preferably planar. The lower section defines an elongate internal tray that forms a lower boundary of the rail channel. The internal tray is sized to receive one or more cables, such as one or more strengthening, communication and/or electrical cables.

The upper section includes a slanted upper front wall, which joins the flat section 26 to a horizontally extending top wall. Preferably, the top wall extends in parallel relationship to the base wall. The top wall in turn joins the upper front wall to a vertically downturned second lip. The upper front wall and top wall are each preferably planar. The gap between the first and second lips extends the full length of the intermediate portion, and is sized to laterally receive a cable therethrough.

In one embodiment, the rail's total width is 2.143 inches and its total height is 1.974 inches. The width of the flat section 26 is 1.105 inches. The internal distance within the rail channel separating the top wall and the base wall is 1.75 inches. The gap between the first and second lips has a width of 1.526 inches. The internal angle between the flat section 26 and the lower front wall is 124 degrees. The internal angle between the flat section 26 and the upper front wall is the same. The internal angle between the lower front wall and the base wall is 146 degrees. The internal angle between the upper front wall and the top wall is the same.

Figure 7:
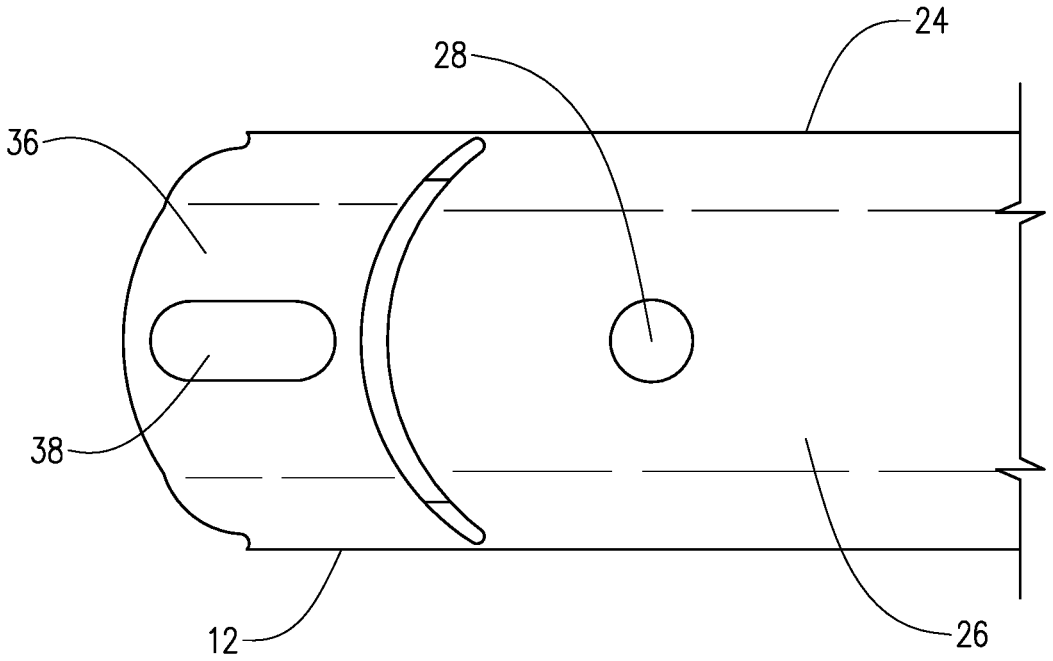
FIG. 7 is an enlarged top plan view of an end portion of the rail shown in FIG. 4.
Figure 8:
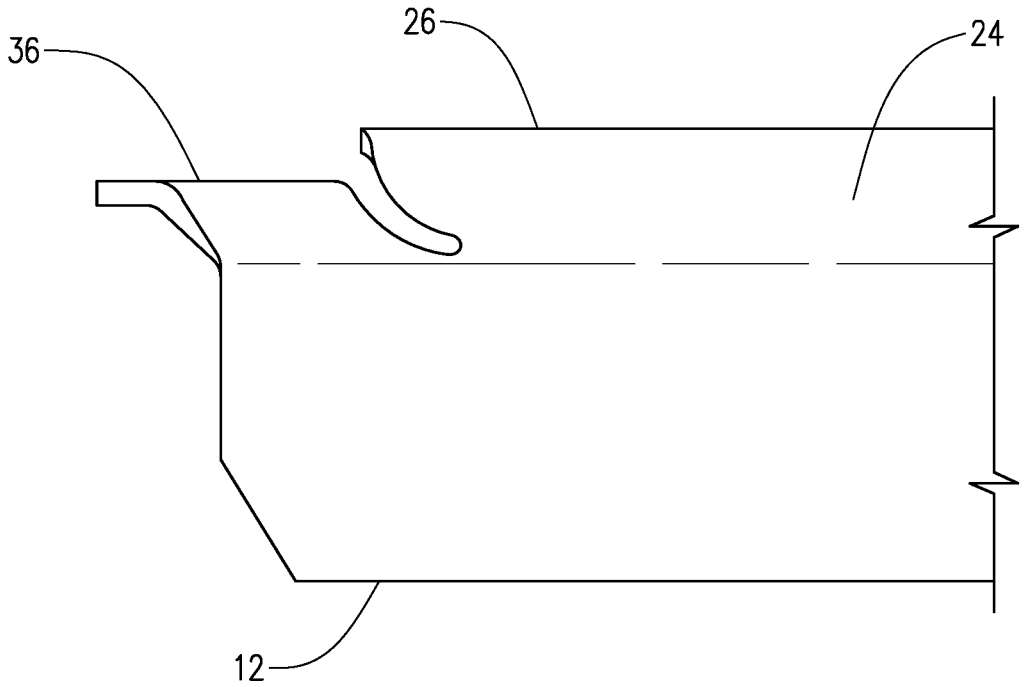
FIG. 8 is an enlarged front view of an end portion of the rail shown in FIG. 4.

FIGS. 7 and 8 illustrate the first end portion of the rail 24. The first end portion is longitudinally bounded by a curved first edge and a spaced and curved second edge. Preferably, the first edge includes a longitudinal extremity of the rail 24, such as the first end. As shown in FIG. 7, the shape of the first end portion at the first edge is convex.

The curves defined by the first and second edges preferably have the same shape, and are uniformly spaced. More preferably, these curves are circular arcs having the same radius. In one embodiment, the radius of the curves defined by first and second edges is 1.125 inches. The separation distance between these edges is 1.125 inches.

The first end portion is sized to be fully received within either of the channel-shaped regions of the post 14. The first end portion includes a planar, vertically extending flat section 36 that is longitudinally bounded by the first and second edges. The flat section 36 is disposed in parallel, but recessed, relationship to the flat section 26 of the intermediate portion. In one embodiment, the spacing between the respective flat sections is 0.25 inches.

A fastener opening 38 is formed in the first end portion of each rail 24, preferably in the flat section 36. The fastener opening 38 should be sized to register with a fastener opening 22 in a flange of the post 14. In one embodiment, each fastener opening 38 is formed in an oblate shape with a major axis that extends parallel to the longitudinal axis of the rail 24. The width of the fastener opening 38 is about 0.35 inches, which is also the minimum dimension of the opening 38. The maximum length of the opening 38 is between about 0.45 and about 0.475 inches.

The first end portion of the rail 24 further comprises a lower section and an upper section. These sections are joined by the flat section 36. Preferably, the lower and upper sections are symmetrical about a bisecting plane that extends orthogonally through the flat section 36.

The lower section includes a slanted lower front wall, which joins the flat section 36 to a horizontally extending base wall. The base wall in turn joins the lower front wall to a vertically upturned first lip. The lower front wall and base wall are each preferably planar. The base wall of the first end portion is aligned with the base wall of the intermediate portion. Similarly, the first lip of the first end portion is aligned with the first lip of the intermediate portion. The lower section thus defines an internal tray joined to the internal tray of the intermediate portion.

The upper section includes a slanted upper front wall, which joins the flat section 36 to a horizontally extending top wall. Preferably, this top wall extends in parallel relationship to the base wall of the first end portion. The top wall in turn joins the upper front wall to a vertically downturned second lip. The upper front wall and top wall are each preferably planar. The top wall of the first end portion is aligned with the top wall of the intermediate portion. Similarly, the second lip of the first end portion is aligned with the second lip of the intermediate portion. The gap between first and second lips of the first end portion is aligned with the gap of identical width in the intermediate portion.

The second end portion of the rail 24 is formed as a mirror image of the first end portion. The first and second end portions are otherwise identical in size, shape and construction. The flat section of the second end portion is coplanar with the flat section 36 of the first end portion.

A punch press is used to form the fastener openings 28 and 38 in the galvanized steel that will be used to form the rail 24. Pairs of curved and spaced slots are next cut in the sheet. These slots correspond to the first and second edges of the first end portion and the corresponding edges of the second end portion. The sheet is then subjected to a cold rolling process to produce a channel-shaped member having the cross-sectional shape of the intermediate portion. At the end of this forming process, a cut-off die depresses flat section 36 relative to flat section 26 between each pair of slots. The die simultaneously cuts away excess material to form a finished rail 24.

Further details about the construction of the rails 24 are provided in U.S. Pat. No. 8,382,070.

Figure 9:
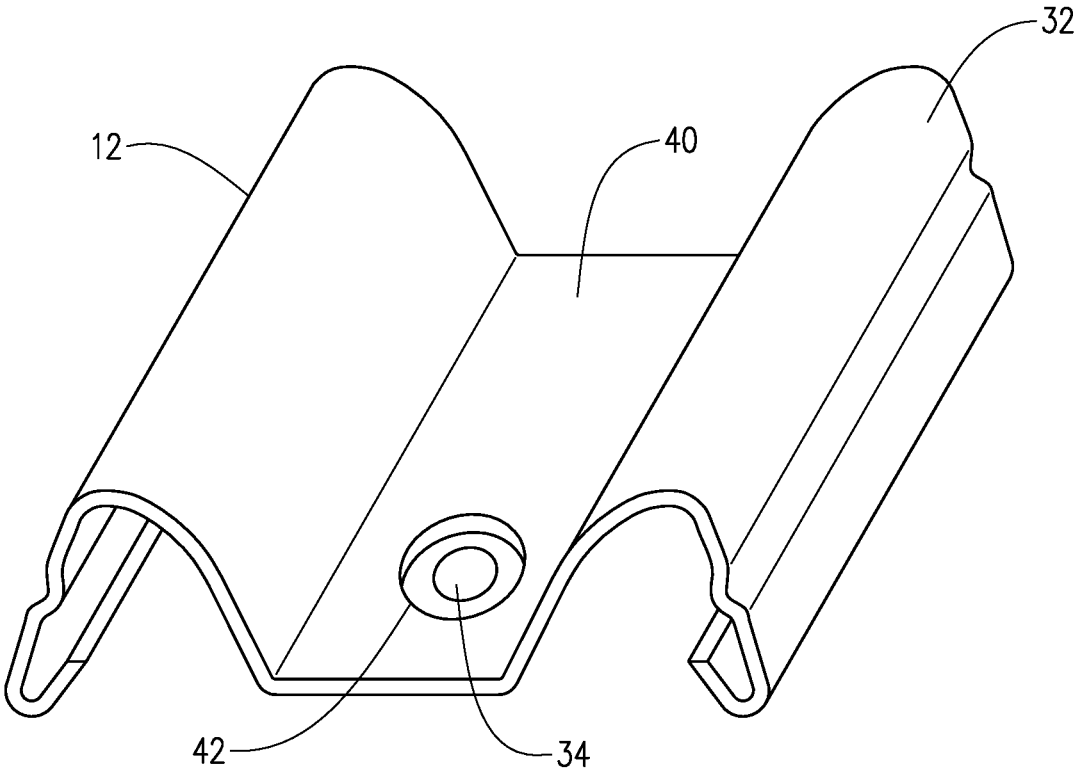
FIG. 9 is a perspective view of a portion of a picket.
Figure 10:
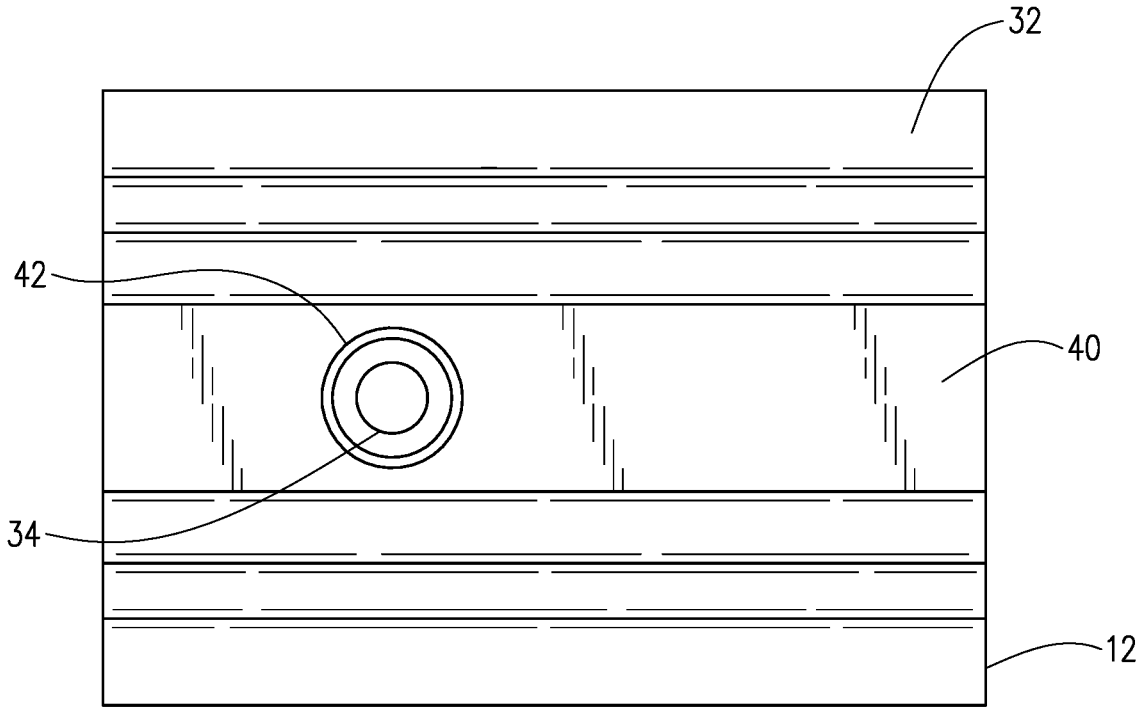
FIG. 10 is a top plan view of the picket shown in FIG. 9.

The structural components 12 preferably further comprise a plurality of elongate pickets 32, shown in detail in FIGS. 9 and 10. The pickets 32 forming the barrier 10 are preferably identical in size, shape and construction.

Each picket 32 is preferably formed from a strong, durable and conductive substrate, such as a strip of sheet steel. In one embodiment, the steel is characterized by a thickness of 0.075 inches. In order to enhance its resistance to corrosion, this steel is preferably subjected to a pre-galvanizing treatment. The pre-galvanized steel is then subjected to a cold rolling process to produce the shape shown in FIG. 9. After fabrication is complete, a nonconductive polyester powder coating is preferably applied, to encase the substrate and further enhance the picket's resistance to corrosion.

The picket 32 is preferably characterized by a substantially W-shaped profile, which provides a corrugated structure that enhances picket strength. The picket 32 includes a pair of laterally opposed side walls, which are preferably inclined toward one another. Extending between the side walls is a generally U-shaped medial section that defines a central first channel. In the installed configuration of the picket 32, the first channel opens in a direction away from the rails 24. The medial section is preferably characterized by a substantially flat central web 40 situated at the base of the first channel. The web 40 functions as an attachment surface for engagement of the picket 32 to the flat section 26 of the rail 24.

One side wall and the medial section further define a U-shaped second channel, situated on one side of the first channel and extending in parallel relationship to the first channel. The second channel is disposed in an inverted relationship to the first channel, opening in a direction opposed to that of the first channel.

The other side wall and the medial section similarly define a U-shaped third channel, situated on the opposite side of the first channel from the second channel and extending in parallel relationship to the first channel. The third channel is disposed in an inverted relationship to the first channel, opening in a direction opposed to that of the first channel, and in the same direction as that of the second channel. The second and third channels are preferably each characterized by a base that is substantially rounded, although a flat base may also be provided.

A plurality of subsurface recesses 42 that open into the first channel are formed in the web 40, preferably by stamping. Each recess 42 should have a depth which is less than the thickness of the web 40. If the thickness of the web 40 is 0.075 inches, for example, a recess 42 having a depth of 0.065 inches may be provided. A centrally-disposed fastener opening 34 is formed in the base of each recess 42, preferably by stamping. Preferably the fastener openings 34 formed in each of the pickets 32 are identically sized and circular. In one embodiment, the diameter of each fastener opening 34 is about 0.35 inches, which is also the minimum dimension of the opening 34.

The upper end of each picket 32 may be formed into a pointed or sharpened shape that will deter and hinder climbing. A spear or spike shape is acceptable for this purpose. In another embodiment, the upper end of each picket can be formed in a splayed configuration that provides a plurality of spear-like protrusions. Alternately, pickets having round or flat tops may be used.

Further details about the construction of the pickets 32 are provided in U.S. Pat. No. 6,874,767, the entire disclosure of which is incorporated by reference.

Each post 14 forming the barrier 10 is securely anchored at its base into a substrate, such as an underground mass of concrete. The depth of the substrate should be at least 3 feet, and may be as much as 5 feet. The anchored posts 14 are situated along the boundary of the area to be enclosed by the barrier 10. The spacing of the posts 14 should be adequate to impart strength to the barrier 10 and to securely anchor other barrier components. In one embodiment, adjacent posts 14 are separated by a distance no greater than 8 feet.

The above-ground height of each installed post 14 is preferably substantially greater than the height of a human or other intruder. In one embodiment, the above-ground height of each post is at least 6 feet, and may be as much as 8 feet or 10 feet. In these embodiments, the total length of each post is at least 9 feet, and may be as much as 13 or 15 feet.

Each rail 24 forming the barrier 10 is supported at its opposite ends by an adjacent pair of posts 14. At least two, and preferably three or more rails 24 extend between each adjacent pair of posts 14. The length of each rail 24 should be sufficient to fully span the distance between the adjacent pair of posts 14. In the embodiment shown in FIG. 1, the length of each rail 24 is 8 feet.

The rails 24 that extend between a given pair of posts 14 are preferably disposed in parallel, vertically-spaced relationship. The incline of each rail 24 should substantially match the incline of the terrain upon which the pair of posts 14 supporting that rail 24 are installed. Thus, when the barrier 10 is positioned on horizontal terrain, as shown in FIG. 1, the rails 24 will be disposed substantially horizontally. When the barrier 10 is installed on a slanted terrain, the rail 24 is preferably tilted, or "racked," to match the terrain's slope.

A rail 24 is installed within the barrier 10 by joining it to a contacting post 14. The first end portion of the rail 24 is first inserted into the post's channel-shaped region. The planar flat section 36 is placed flush against the planar inner surface of flange 18, and the fastener openings 22 and 38 are aligned. A fastener 30 is next inserted through the aligned openings 22 and 38 of the two structural components. The fastener 30 is then actuated to join the rail 24 to the post 14.

The rail 24 is joined at its second end to another post 14 that will form the barrier 10, using the same steps. Additional rails 24 are joined to posts 14 forming the barrier 10 in the same way.

Each picket 32 is supported by the vertically spaced rails 24 forming the barrier 10. The vertical height of each picket 32 is preferably approximately equal to the vertical above-ground height of each post 14. The pickets 32 are preferably oriented in parallel relationship, with a spacing between adjacent pickets 32 that is sufficiently small to prevent an intruder from traversing the picket-picket gap. In one embodiment, the separation distance between the centers of adjacent pickets 32 is no more than 6 inches. If a picket 32 adjoins a post 14, the post-picket spacing should be at least as small as the spacing between adjacent pickets.

Between adjacent pairs of posts 14, pickets 32 should be provided in sufficient number to assure that the picket-picket and picket-post spacing does not exceed the requisite distance. In the embodiment shown in FIG. 1, for example, 15 pickets are installed with a center-to-center picket separation of 6 inches.

The base of each picket 32 is preferably situated no more than a small distance above the terrain supporting the barrier 10. Such positioning renders it more difficult for an intruder to traverse the gap between the base of the picket 32 and the terrain.

A picket 32 is installed within the barrier 10 by joining it to a contacting rail 24. The picket 32 is oriented vertically such that the flat web 40 contacts the flat sections 26 of the rails 24. The fastener openings 34 formed in the recesses 42 of the picket 32 are aligned with corresponding fastener openings 28 formed in the flat sections 26 of the rails 24. A fastener 30 is next inserted through a pair of the aligned openings. The fastener 30 is then actuated to join the picket 32 to a rail 24.

Using the same steps, the picket 32 is attached to additional rails 24 at aligned fastener openings 34 and 28 along the length of the picket 32. Additional pickets 32 are attached to the rails 24 forming the barrier 10 in the same way.

In order to permit the same fastener 30 to be used with each of the fastener openings 22, 28, 34 and 38, it is preferred that these fastener openings have at least the same minimum dimension. In some embodiments, one or more of the openings 22, 28, 34 and 38 may have the same size. Thus, in the embodiment shown in the Figures, the openings 28 and 34 are the same size, and the openings 22 and 38 are the same size. All of the openings 22, 28, 34 and 38 have the same minimum dimension.

The fastener 30 is shown in FIGS. 11-15, and is preferably formed from a bolt 44 and nut 46. Components of the fastener 30 should be formed from a strong and durable material, such as hardened steel. The bolt 44, and preferably the nut 46 as well, should be conductive.

Figure 11:
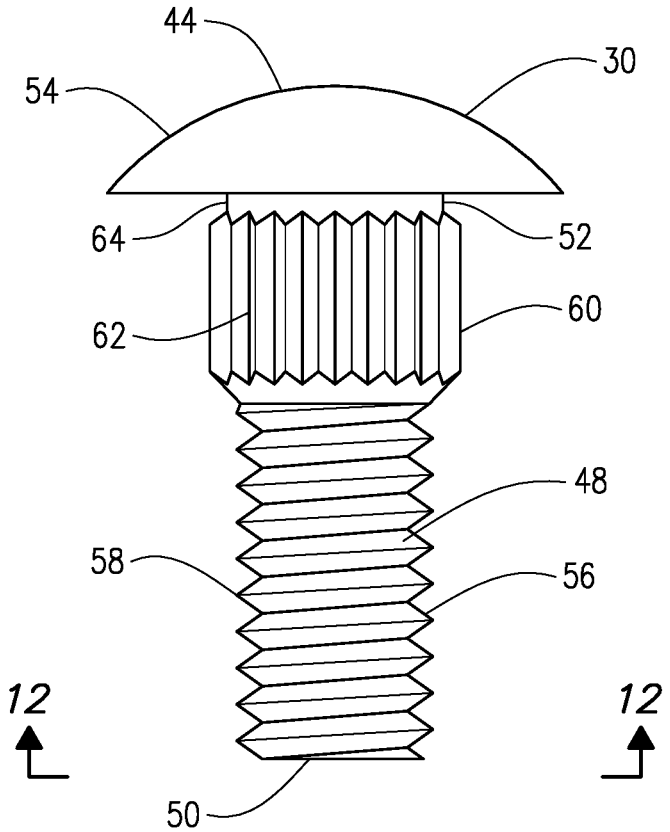
FIG. 11 is a front elevation view of a bolt.
Figure 12:
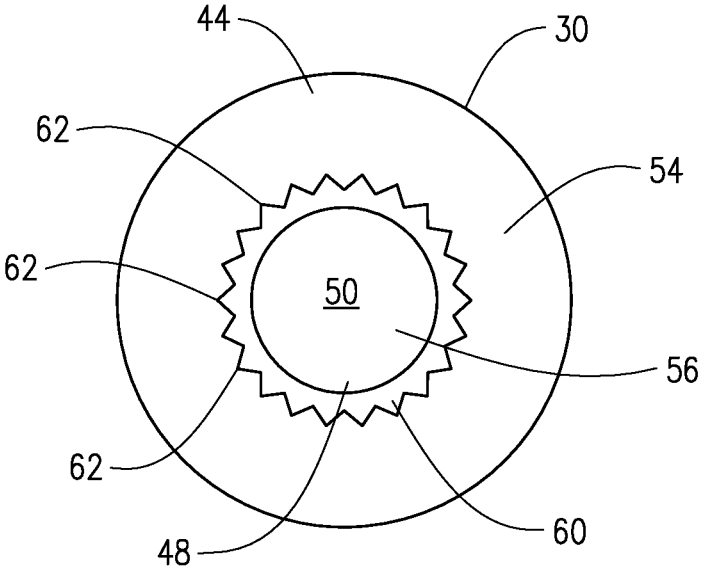
FIG. 12 is a bottom plan view of the bolt shown in FIG. 11, taken along line 12-12.

The bolt 44, shown in detail in FIGS. 11 and 12, is formed from an elongate shank 48 having a first end 50 and a second end 52. An enlarged head 54 is supported by the shank 48 at its second end 52. Preferably, the head 54 is characterized by a domed shape with a circular cross section.

The shank 48 is characterized by a first section 56 having external threads 58 that is formed at or adjacent the first end 50. The shank 48 further comprises a second section 60 situated in longitudinally offset relationship to the first section 56. The second section 60 has maximum cross-sectional dimensions that exceed those of the first section 56, and is sized to form an interference fit within the fastener opening of any structural component 12. Preferably the second section 60 immediately adjoins the first section 56.

The second section 60 is characterized by a plurality of ridges 62 formed on the surface of the shank 48. The ridges 62 extend longitudinally along the shank 48, in parallel relationship, and preferably are uniformly spaced around the periphery of the shank 48.

The shank 48 preferably further comprises a third section 64 situated in longitudinally offset relationship to the second section 60. Preferably, the third section 64 immediately adjoins the second section 60 and extends to the second end 52 of the shank 48. The third section 64 is preferably smooth, with maximum cross-sectional dimension that are less than those of the second section 60. The third section 64 is sized to receive an annular sealing washer (not shown) that can be positioned immediately beneath the head 54. The sealing washer functions to protect components of the barrier 10 from moisture.

Figure 13:
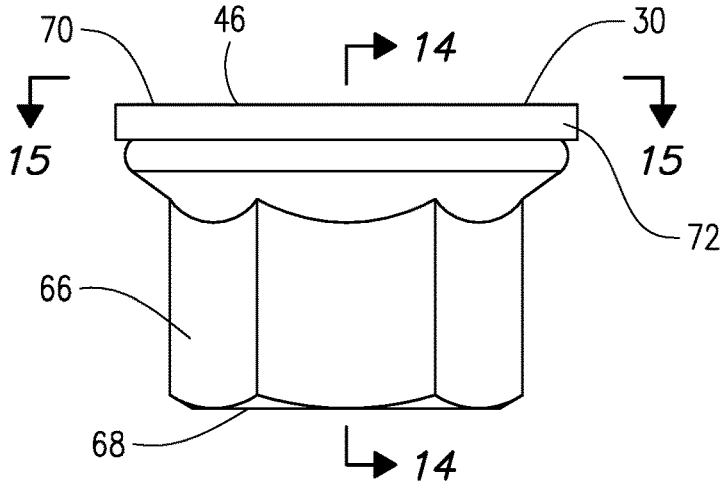
FIG. 13 is a front elevation view of a nut.
Figure 14:
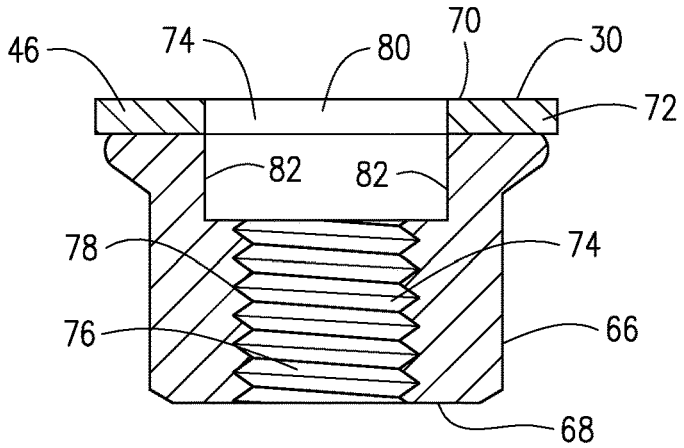
FIG. 14 is a cross-sectional view of the nut shown in FIG. 13, taken along line 14-14.
Figure 15:
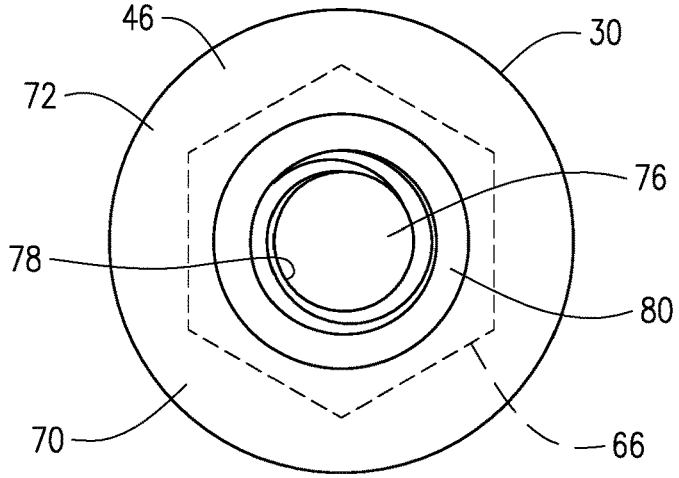
FIG. 15 is a top plan view of the nut shown in FIG. 13, taken along line 15-15. The nut body is shown in dashed lines.
Figure 7:
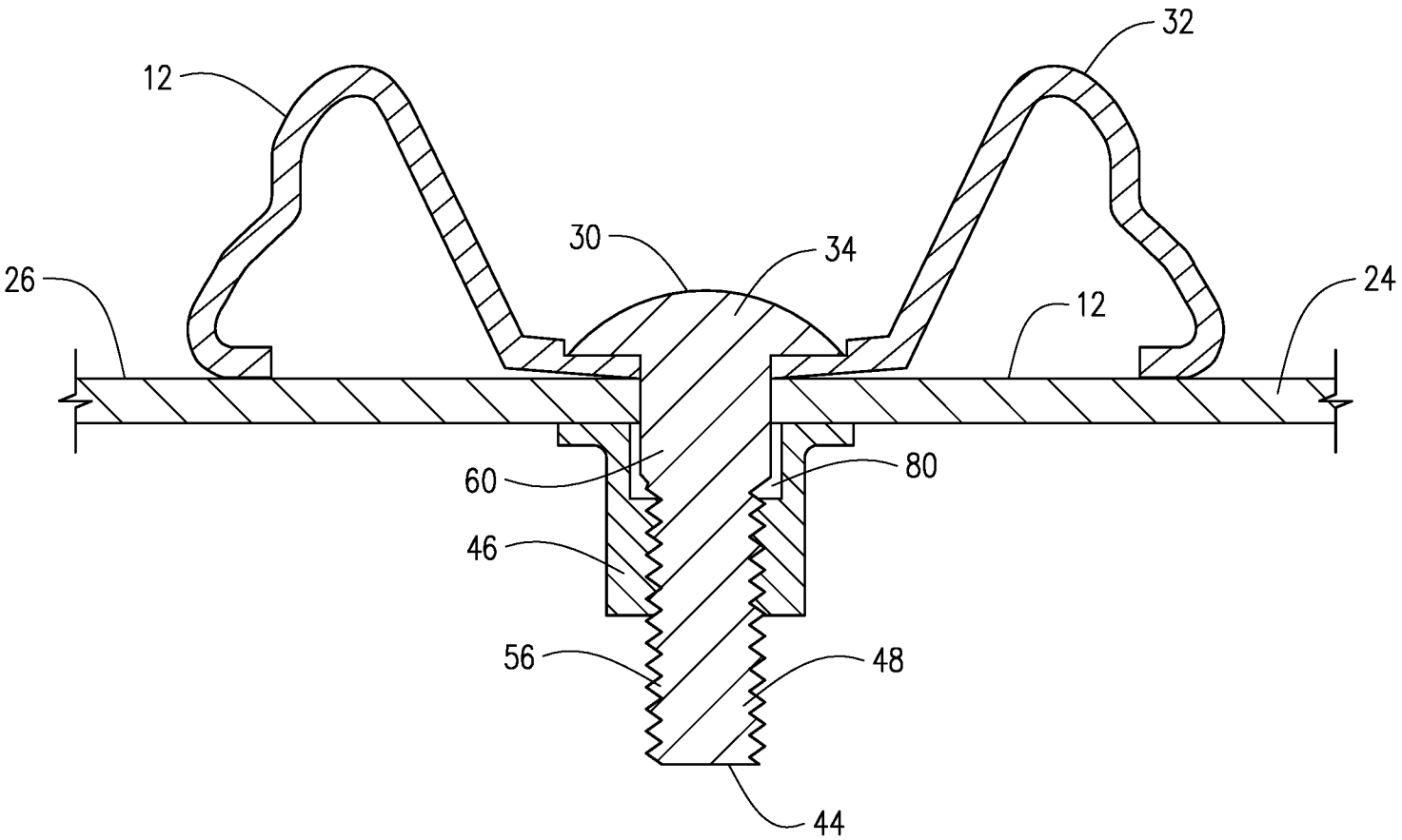

The nut 46, shown in detail in FIGS. 13-15, is formed as a separate component from the bolt 44. The nut 46 features a body 66 having a first end 68 and a second end 70. An enlarged and flat base 72 is formed at the second end 70, and is preferably characterized by a circular cross-sectional shape. At and immediately adjacent its first end 68, the body 66 is preferably characterized by a uniform hexagonal cross-sectional shape.

The nut 46 is perforated between first and second ends 68 and 70 by an internal bore 74 that extends in coaxial relationship to the body 66. The bore 74 is preferably characterized by a first section 76 that extends from the first end 68 of the body 66. The first section 76 has a substantially circular cross-sectional shape of uniform size, and is characterized by internal threads 78. These internal threads 78 mate with the external threads 58 formed at the first section 56 of the shank 48 of bolt 44.

The bore 68 is further characterized by a coaxial second section 80 that is longitudinally offset from the first section 76. The second section 80 joins the first section 76 within the body 66, and opens at the base 72. The second section 80 is preferably characterized by circular cross-sectional shape of a uniform size that is larger than the cross-sectional size of the first section 76. The side walls 82 forming the second section 80 are preferably smooth and unthreaded. The second section 80 is sized to closely but clearingly receive a portion of the second section 60 of the shank 48.

In one embodiment, the bolt 44 has a shank 48 with an overall length of about 1.25 inches. The length of the first section 56 is about 0.815 inches, the length of the second section 60 is about 0.310 inches, and the length of the third section 64 is about 0.125 inches. The first section 56 is characterized by a 5/16-18 thread. The second section 60 has a maximum cross-sectional dimension of about 0.365 inches, which exceeds the 0.3125 inch major diameter of the first section 56. The number of ridges 62 formed on the shank 48 is about 21. The second section 60 is adapted to form an interference fit with a fastener opening having a minimum dimension of about 0.35 inches. The diameter of head 54 is about 0.705 inches, and its height is about 0.166 inches.

In the same embodiment, the nut 46 has an overall height of about 0.49 inches. The diameter of the base 72 is about 0.75 inches. The length of first section 76 is about 0.30 inches, and the length of second section 80 is about 0.19 inches. The first section 76 is characterized by a 5/16-18 thread. The second section 80 has a diameter of 0.41 inches.

Figure 17:
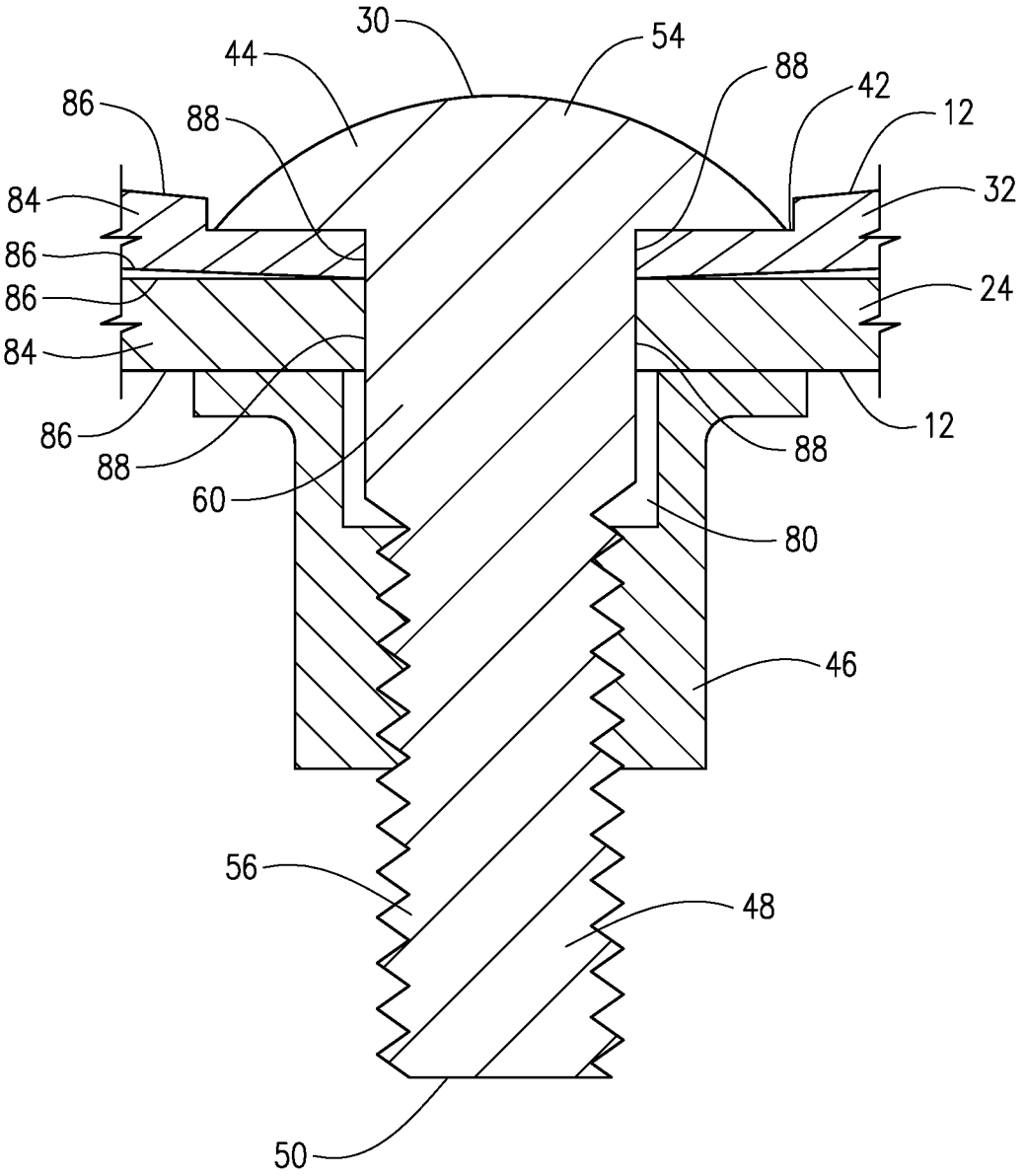
FIG. 17 is an enlarged cross-sectional view of the picket-rail assembly of FIG. 16, showing the positioning of the bolt and nut.
Figure 7:
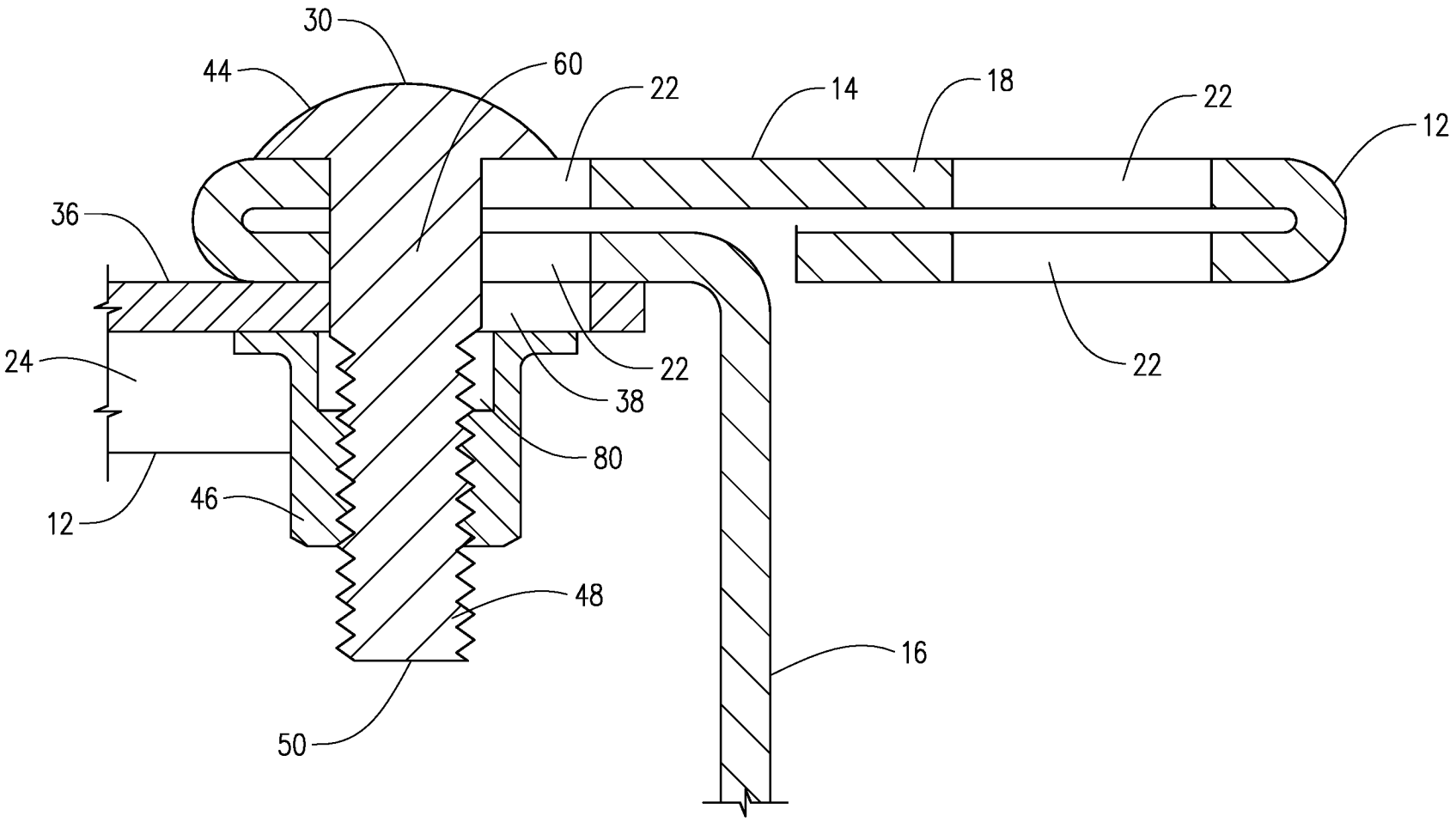

FIGS. 16-19 show how the fastener 30 is used to assemble structural components 12 forming a barrier 10. As best shown in FIGS. 17 and 19, each of these structural components 12 is formed from a conductive substrate 84 encased by a nonconductive coating 86.

FIGS. 16 and 17 show how the fastener 30 is used to join a picket 32 to a rail 24. As previously described, the fastener openings 28 and 34 are aligned. Next, the second section 60 of the shank 48 of a bolt 44 is caused to form an interference fit within each of the aligned fastener openings. Preferably, the interference fit is formed by pressing the second section 60 into the slightly smaller fastener openings 28 and 34. Once this interference fit has been formed, the nut 46 is threaded onto bolt 44 and tightened against the rail 24.

As described previously, the fastener openings 28 and 34 of rail 24 and picket 32 have the same shape. Moreover, that shape is the same as the cross-sectional profile of the second section 80 of the shank 48. The second section 60 accordingly forms an interference fit around the full periphery of each of the fastener openings 28 and 34.

When the fastener 30 joins a picket 32 to a rail 24, the lower portion of second section 60 does not contact either the picket 32 or the rail 24. To permit the nut 46 to be fully tightened against the rail 24, the second section 80 of the nut 46 is sized to receive the lower portion of the second section 60 of the shank 48.

Forming an interference fit with the shank 48 causes the nonconductive layer of coating 86 within each of the aligned fastener openings to abrade away. This leaves an exposed conductive substrate in direct contact with the conductive shank 48 at each of the zones 88. The shank 48 of each bolt 44 thus forms a conductive link between the contacting picket-rail pair that it joins.

Figure 18:
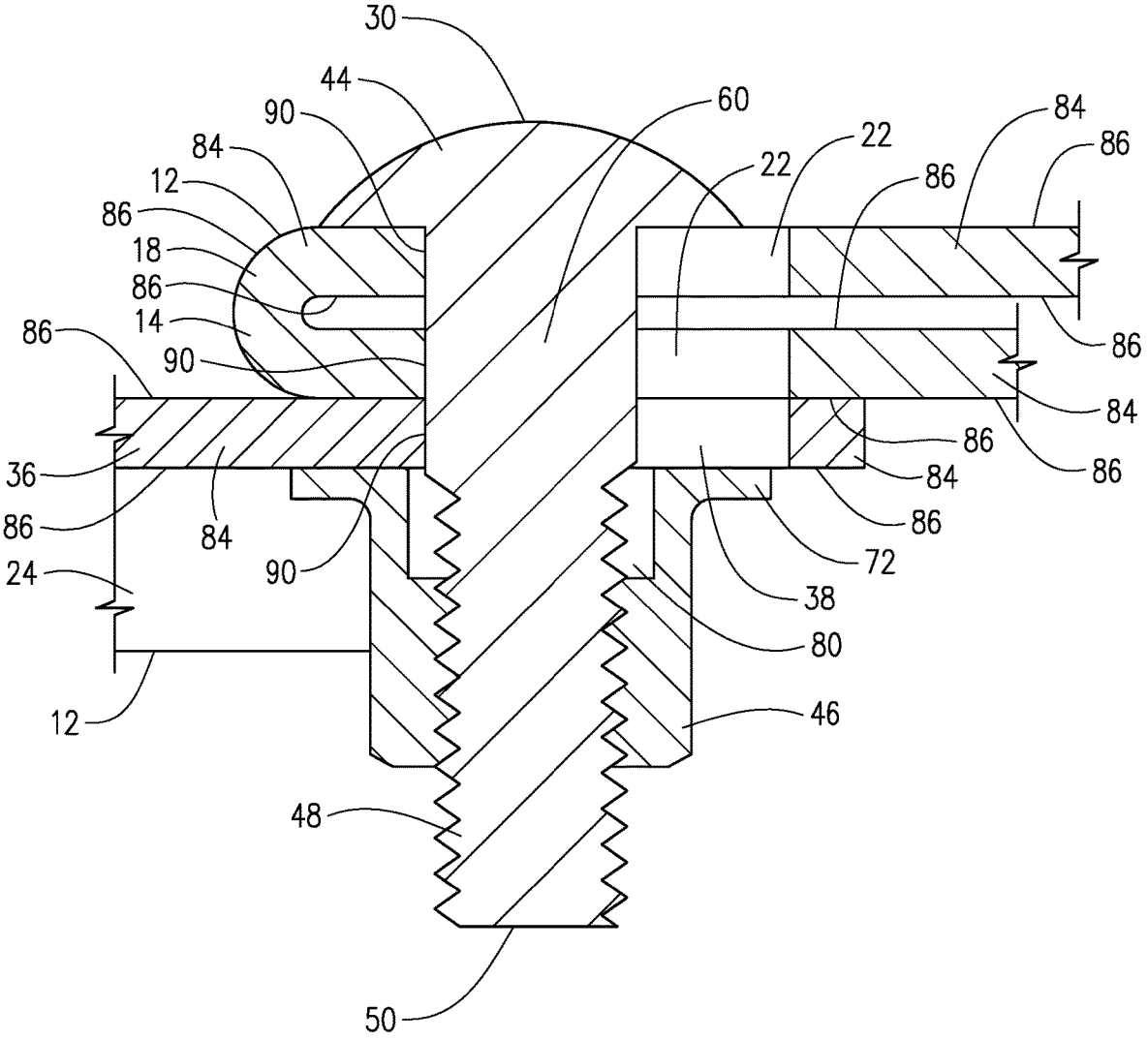
FIG. 18 is a cross-sectional view showing a rail installed on a post.

FIGS. 18 and 19 show how the fastener 30 is used to join a rail 24 to a post 14. As previously described, the fastener openings 22 and 38 are aligned. Next, the second section 60 of the shank 48 of a bolt 44 is caused to form an interference fit with each of the aligned fastener openings 22 and 38. Preferably, the interference fit is formed by pressing the shank 48 into the slightly narrower fastener openings 22 and 38.

As described previously, the fastener openings 22 and 38 of post 14 and rail 24 have the same shape. However, that shape is different than the cross-sectional profile of the second section 60 of the shank 48. While there is less than full contact between the shank 48 and the openings 22 and 38, an interference fit is still formed at two opposed contact points within each opening.

The entire second section 60 is needed to form interference fits within the aligned fastener openings 22 and 38 in the rail 24 and post 14. As a result, there is no need to receive any portion of the second section 60 within the enlarged second section 80 of the nut 46. However, the enlarged second section 80 remains useful by allowing the same fastener 30 to be used, not just with rails 24 and posts 14, but with pickets 32 and rails 24 as well.

Forming an interference fit with the shank 48 causes the nonconductive layer of coating 86 within each of the aligned fastener openings to abrade away. This leaves an exposed conductive substrate in direct contact with the conductive shank 48 at each of the zones 90. The shank 48 of each bolt 44 thus forms a conductive link between the contacting post-rail pair that it joins.

Use of the fasteners 30 allows conductive linkage between all of the structural components 12 forming the barrier 10. Such linkage facilitates effective grounding, or electrification, of the entire barrier 10.

Without the conductive link formed within the fastener openings by the shank 48, the external layer of nonconductive coating 86 may leave pickets 32, rails 24 and posts 14 in electrical isolation from one another, even when these structural components 12 are in contact. Such electrical isolation may frustrate complete grounding of the barrier 10. Such grounding may be necessary when the barrier 10 is used to protect electric power installations, or other areas where static electricity discharge may pose safety risks.

The barrier 10 may be assembled from a kit. Such a kit should comprise at least one post 14, at least one rail 24, and at least one fastener 30. The kit may further comprise at least one picket 32. Preferably, a plurality of each of these structural components 12 and each of the fasteners 30 are included in the kit.

Changes may be made in the construction, operation and arrangement of the various parts, elements, steps and procedures described herein without departing from the spirit and scope of the invention as described in the following claims.

The invention claimed is:

1. A barrier, comprising:
- a plurality of structural components, each formed from a conductive substrate encased by a nonconductive coating and penetrated by at least one fastener opening; and
- a plurality of fasteners that join pairs of structural components, each fastener comprising:
  - a conductive bolt, comprising:
    - an elongate shank, comprising:
      - an externally threaded first section formed at or adjacent one end of the shank; and
      - a second section longitudinally offset from the first section, the second section forming an interference fit within the aligned fastener openings of a pair of structural components.

2. The barrier of claim 1 in which the second section is characterized by a plurality of ridges formed on the surface of the shank.

3. The barrier of claim 2 in which the ridges extend longitudinally and in parallel relationship.

4. The barrier of claim 3 in which the ridges are spaced uniformly about the periphery of the shank.

5. The barrier of claim 2 in which the ridges are spaced uniformly about the periphery of the shank.

6. The barrier of claim 1 in which the plurality of structural components includes at least one post and at least one rail.

7. The barrier of claim 6 in which the plurality of structural components includes at least one post, at least one rail, and at least one picket.

8. The barrier of claim 7 in which the at least one post comprises at least two posts embedded within a terrain, in which the at least one rail comprises at least two rails, each rail supported at its opposite ends by an adjacent pair of posts, and in which the at least one picket is supported by an adjacent pair of rails.

9. The barrier of claim 6 in which the at least one post comprises at least two posts embedded within a terrain, and in which the at least one rail is supported at its opposite ends by an adjacent pair of posts.

10. The barrier of claim 1 in which the fastener opening of at least one structural component has the same shape as the cross-sectional profile of the second section of the shank.

11. The barrier of claim 1 in which the fastener opening of at least one structural component has a shape different than the cross-sectional profile of the second section of the shank.

12. The barrier of claim 1 in which each fastener further comprises:
- a separate nut having a body perforated by an internal bore, the bore having a threaded first section and an offset second section sized to closely but clearingly receive a portion of the second section of the shank.

13. A kit, comprising:
- a plurality of structural components, each formed from a conductive substrate encased by a nonconductive coating and penetrated by at least one fastener opening; and
- a plurality of fasteners adapted to join pairs of structural components, each fastener comprising:
- a conductive bolt, comprising:
  - an elongate shank, comprising:
    - an externally threaded first section formed at or adjacent to one end of the shank; and a second section longitudinally offset from the first section, the second section adapted to form an interference fit within the aligned fastener openings of a pair of structural components.

14. The kit of claim 13 in which the second section is characterized by a plurality of ridges formed on the surface of the shank.

15. The kit of claim 14 in which the ridges extend longitudinally and in parallel relationship.

16. The kit of claim 15 in which the ridges are spaced uniformly about the periphery of the shank.

17. The kit of claim 14 in which the ridges are spaced uniformly about the periphery of the shank.

18. The kit of claim 13 in which the plurality of structural components includes at least one post and at least one rail.

19. The barrier of claim 18 in which the plurality of structural components includes at least one post, at least one rail, and at least one picket.

20. The kit of claim 13 in which the fastener opening of at least one structural component has the same shape as the cross-sectional profile of the second section of the shank.

21. The kit of claim 20 in which the fastener opening of at least one structural component has a shape different than the cross-sectional profile of the second section of the shank.

22. The kit of claim 13 in which each fastener further comprises:

a separate nut having a body perforated by an internal bore, the bore having a threaded first section and an offset second section sized to closely but clearingly receive a portion of the second section of the shank.

* * * * *